US008666609B2

(12) United States Patent
Iida

(10) Patent No.: US 8,666,609 B2
(45) Date of Patent: Mar. 4, 2014

(54) WORK VEHICLE

(75) Inventor: Tetsuya Iida, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 604 days.

(21) Appl. No.: 13/018,096

(22) Filed: Jan. 31, 2011

(65) Prior Publication Data

US 2012/0195727 A1 Aug. 2, 2012

(51) Int. Cl.

| | |
|---|---|
| ***G06F 7/70*** | (2006.01) |
| ***G06F 19/00*** | (2011.01) |
| ***G06G 7/00*** | (2006.01) |
| ***G06G 7/76*** | (2006.01) |
| ***G05D 1/02*** | (2006.01) |
| ***G05D 1/04*** | (2006.01) |
| ***F15B 11/00*** | (2006.01) |
| ***F15B 13/00*** | (2006.01) |
| ***B66C 23/00*** | (2006.01) |
| ***B66F 9/00*** | (2006.01) |
| ***E02F 3/00*** | (2006.01) |

(52) U.S. Cl.

USPC ..... 701/50; 37/348; 91/534; 414/699

(58) Field of Classification Search

USPC ..... 414/685; 37/196, 195, 348; 60/400, 60/413–420; 91/1–50; 137/596, 625

See application file for complete search history.

(56) References Cited

U.S. PATENT DOCUMENTS

| | | | | |
|---|---|---|---|---|
| 5,957,149 | A * | 9/1999 | Karg | 137/119.04 |
| 6,142,724 | A * | 11/2000 | Hirooka et al. | 414/686 |
| 6,698,114 | B2 * | 3/2004 | Bares et al. | 37/403 |
| 7,008,169 | B1 * | 3/2006 | Miyanishi | 414/722 |
| 7,861,741 | B2 * | 1/2011 | Kress | 137/556.3 |
| 8,246,286 | B2 * | 8/2012 | Fukudome et al. | 414/686 |
| 2005/0132877 | A1 * | 6/2005 | Hart | 91/509 |
| 2007/0220878 | A1 * | 9/2007 | Ramun | 60/413 |
| 2008/0041458 | A1 * | 2/2008 | Dietrich et al. | 137/383 |
| 2008/0063502 | A1 * | 3/2008 | Nilsson | 414/685 |
| 2009/0056325 | A1 * | 3/2009 | Gary et al. | 60/421 |
| 2011/0000203 | A1 * | 1/2011 | Riedel et al. | 60/327 |

FOREIGN PATENT DOCUMENTS

| | | |
|---|---|---|
| JP | 2010-185246 | 8/2010 |

* cited by examiner

*Primary Examiner* — Saul Rodriguez
*Assistant Examiner* — Ronald Jarrett
(74) *Attorney, Agent, or Firm* — Sterne, Kessler, Goldstein & Fox P.L.L.C.

(57) ABSTRACT

A tractor includes booms, lift cylinders, a hitch, dump cylinders, a magnetic valve, a speed-up circuit, and a speed-up restricting arm. The lift cylinders swing the booms upward and downward by an operating oil being supplied thereto. The hitch is provided to the booms to allow an implement to be attached thereto. The dump cylinders swing the implement upward and downward by the operating oil being supplied thereto. The magnetic valve switches between supplying the operating oil to the dump cylinders and supplying the operating oil to a grab cylinder provided in the implement. The speed-up circuit is able to perform a speed-up operation for increasing the flow rate of the operating oil supplied to the magnetic valve. The speed-up restricting arm is arranged near the speed-up circuit. The speedup restricting arm is brought into contact with a contact member attached to an input member for switching an operation of the speed-up circuit, to thereby restrict the speed-up operation, so that a speed-up of the grab cylinder is prevented.

4 Claims, 9 Drawing Sheets

WORK VEHICLE

BACKGROUND OF THE INVENTION

1. Field of the Invention

The present invention relates to a work vehicle such as a tractor, and more specifically relates to a work vehicle having a loader provided in a front or rear part of a vehicle body thereof.

2. Description of the Background Art

In a known structure, in a loader mounted to a work vehicle such as a tractor, a pair of left and right booms are moved up and down by a cylinder or a link mechanism, and a scooping action and a dumping action are performed by using a bucket or the like arranged at distal ends of the booms (for example, see Japanese Patent Application Laid-Open No. 2010-185246).

In the tractor and the like, instead of the bucket, an implement having an oil hydraulic cylinder may be attached to the distal end of the booms. Known examples of the implement include a roll grab, a grapple, a bucket with grapple, and a bucket having an openable bottom. The roll grab has a pair of left and right arms openable and closable in a left-and-right direction. An oil hydraulic cylinder provided in the roll grab for an opening and closing operation is extended and retracted, and thereby the arms are opened and closed in the left-and-right direction to perform a gripping action for gripping a roll bale or the like. The grapple has a pair of comb-like arms openable and closable in an up-and-down direction. An oil hydraulic cylinder provided in the grapple for an opening and closing operation is extended and retracted, and thereby the arms are opened and closed in the up-and-down direction to perform a gripping action for gripping a fallen tree or the like. The bucket with grapple has a comb-like grapple movable in the up-and-down direction being provided above a normal bucket. An oil hydraulic cylinder provided in the bucket is extended and retracted, and thereby a gripping action is performed for gripping a fallen tree or the like with the bucket and the grapple. In the bucket having the openable bottom, an oil hydraulic cylinder provided in the bucket is extended and retracted, and thereby a bottom surface is opened to discharge soil out of the bucket.

The above-mentioned work vehicle sometimes adopts a structure in which the flow rate of an operating oil supplied in order to move the cylinder to one side can be increased by a predetermined operation. In such a structure, in a case where a bucket is mounted to the booms, a dumping action of the bucket can be performed at a higher speed as compared with the scooping action, thus achieving an improved operation efficiency. However, in this structure, in a case where an implement (such as the roll grab) including an oil hydraulic cylinder is attached, only one of extension and retraction of the cylinder of the implement is performed at a high speed. For example, in a case where the roll grab or the grapple is attached, only one of an opening operation and a closing operation of the arms can be performed at an increased speed. This may confuse an operator.

SUMMARY OF THE INVENTION

The present invention has been accomplished under such circumstances, and an object of the present invention is to provide a work vehicle capable of performing a dumping action or the like at a high speed and preventing a high-speed operation of a drive part provided in an implement, by means of a compact structure.

Means for Solving the Problems and Effects

Problems to be solved by the present invention are as described above, and next, means for solving the problems and effects thereof will be described.

In an aspect of the present invention, a work, vehicle configured as follows is provided. The work vehicle includes a vehicle body, a boom, a first drive part, an attaching part, a second drive part, a switching valve, a speed-up part, and a restricting part. The boom extends to the front or to the rear of the vehicle body. The first drive part is configured to swing the boom upward and downward by an operating oil being supplied thereto. The attaching part is provided to the boom to allow an implement to be attached thereto. The second drive part is configured to swing the implement upward and downward by the operating oil being supplied thereto. The switching valve is configured to switch between supplying the operating oil to the second drive part and supplying the operating oil to a third drive part provided in the implement. The speed-up part is able to perform a speed-up operation for increasing the flow rate of the operating oil supplied to the switching valve. The restricting part is arranged near the speed-up part. The restricting part is configured to be brought into contact with a switching member for switching an operation of the speed-up part or with a member attached to the switching member, to thereby restrict the speed-up operation so that a speed-up of the third drive part is prevented.

This enables a speed-up of a dumping action of a bucket, and the like, by increasing the flow rate of the operating oil supplied to the second drive part while, in a case of performing an operation with attaching the implement (such as a roll grab or a grapple) having the third drive part, preventing a speed-up of an action of the implement (such as a gripping action of the roll grab or the grapple). Therefore, an operation can be appropriately performed using the implement having the third drive part. Additionally, since the restricting part arranged near the speed-up part, a complicated link mechanism or the like for restricting the speed-up operation is not required. Thus, a configuration of the restricting part can be simplified.

The work vehicle is preferably configured as follows. The work vehicle includes an operating part and a detecting part. The operating part is able to perform an operation for driving the third drive part. The detecting part is configured to detect that the speed-up operation is restricted. When the operation for driving the third drive part is performed by using the operating part and the detecting part detects that the speed-up operation is restricted, the switching valve supplies the operating oil to the third drive part.

In this configuration, in a state where the speed-up operation is not restricted, the operation using the implement having the third drive part cannot be performed. This can furthermore ensure the prevention of the speed-up of the operation of the implement having the third drive part.

The work vehicle is preferably configured as follows. The work vehicle includes a loader attachable to and removable from the vehicle body. The loader includes at least the boom, the attaching part, the first drive part, and the second drive part. In a state where the loader is removed from the vehicle body, the switching valve is located in the loader.

In this configuration, to mount the loader to the vehicle body, a necessary operation of connecting hydraulic pipes is merely connecting hydraulic pipes extending from an operating-oil tank of the vehicle body to the first drive part and the switching valve of the loader. This can simplify an operation for attachment and removal of the loader, as compared with connecting and disconnecting the hydraulic pipes for each drive part.

The work vehicle is preferably configured as follows. The work vehicle includes hydraulic pipes for supplying the operating oil to the first drive part, the second drive part, and the third drive part. The hydraulic pipes are arranged so as to define a passing region where the hydraulic pipes pass near a surface of the boom facing the vehicle body side, and in the passing region, at least one of the hydraulic pipes overlaps at least a part of the other hydraulic pipes in a side view In this configuration, the hydraulic pipes are attached so as to pass inside the boom. This can prevent the hydraulic pipes from being damaged due to a contact with an obstacle existing outside. Moreover, such a layout in which the hydraulic pipes overlap each other can prevent the hydraulic pipes from sticking out of the boom even if the boom is thin (or the hydraulic pipe is thick).

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 2:
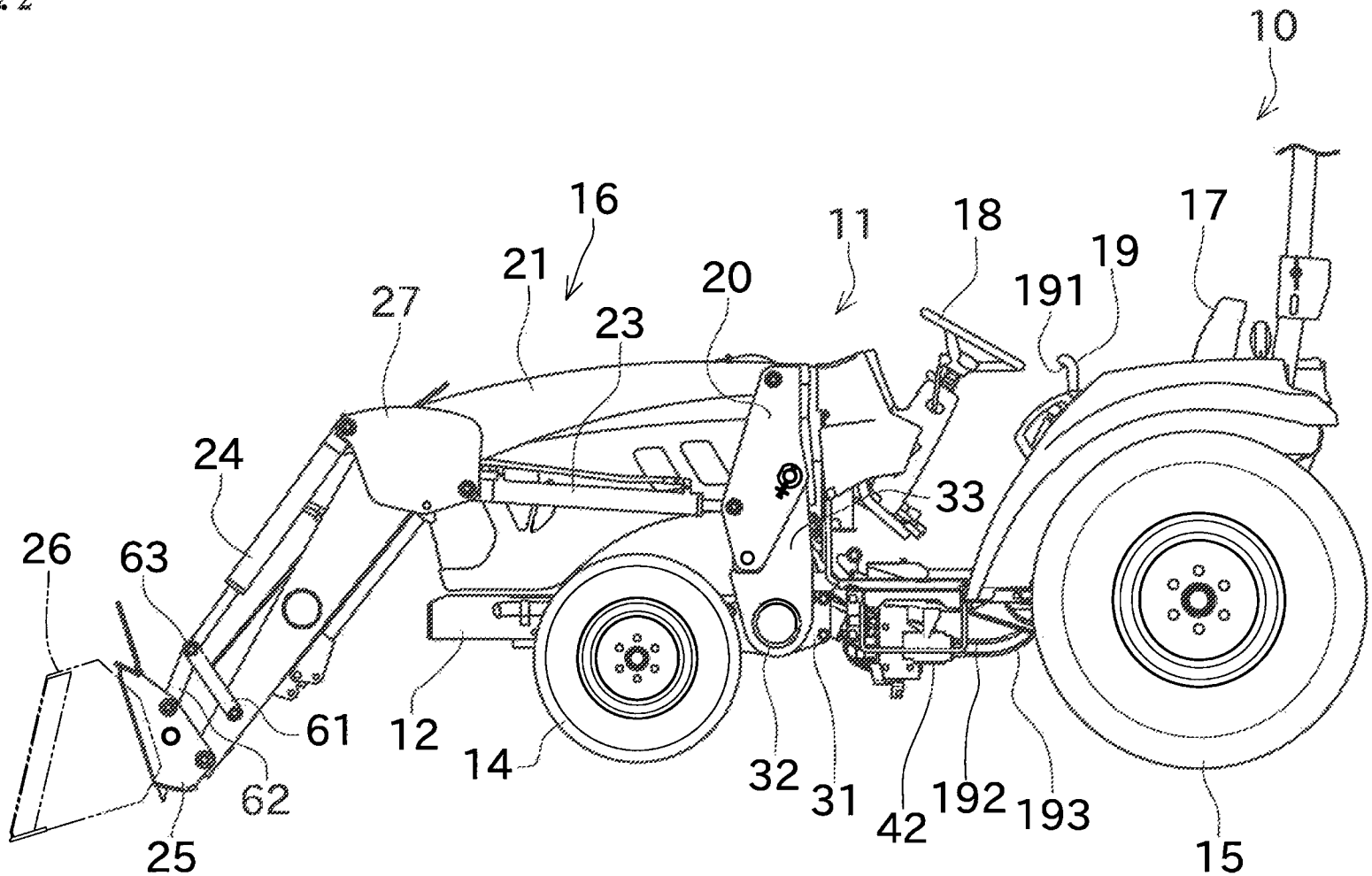
FIG. 2 is a side view showing an entire structure of a tractor according to an embodiment of the present invention.
Figure 3:
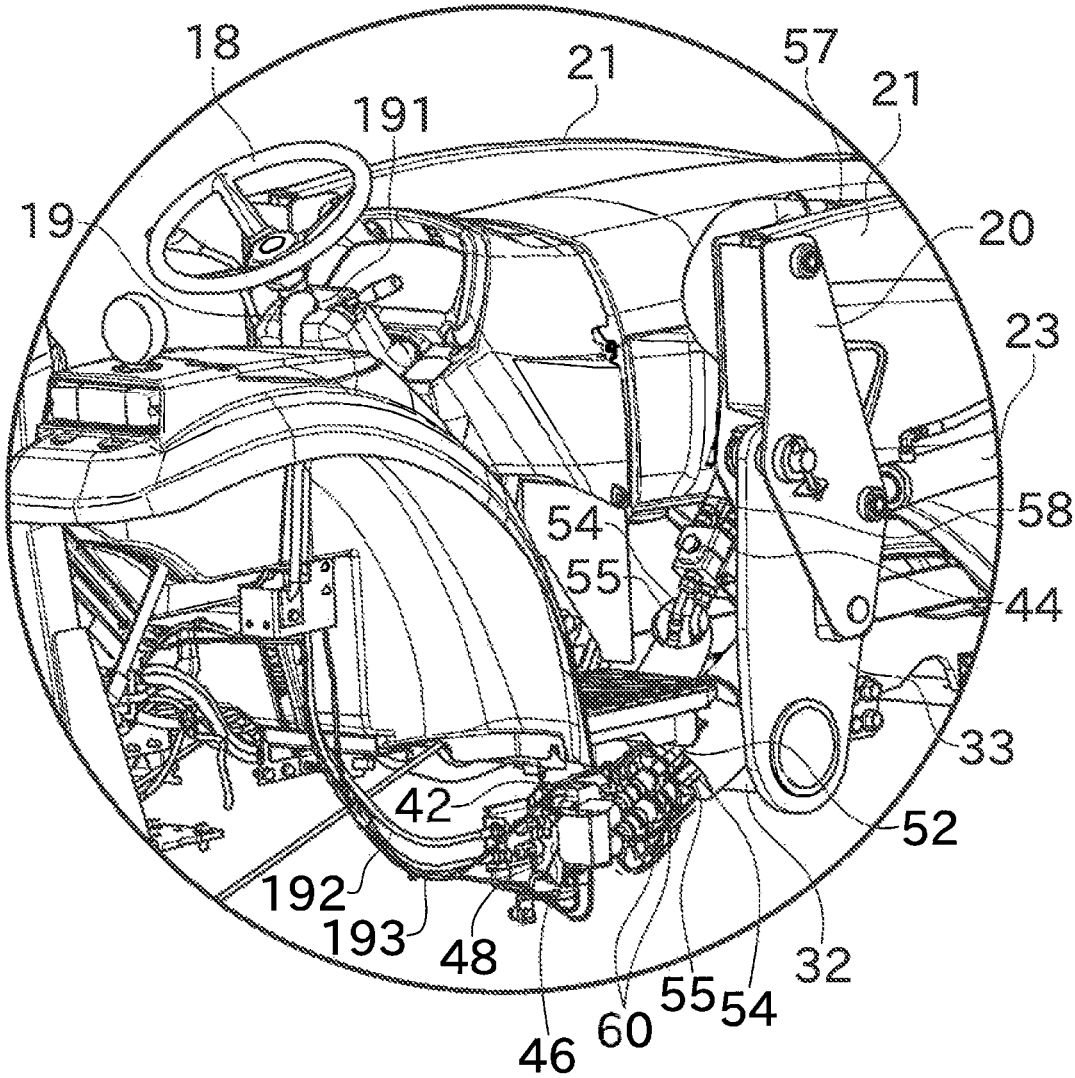
FIG. 3 is a perspective view showing a structure around a loader control lever, a multiple valve, and a magnetic valve.
Figure 4:
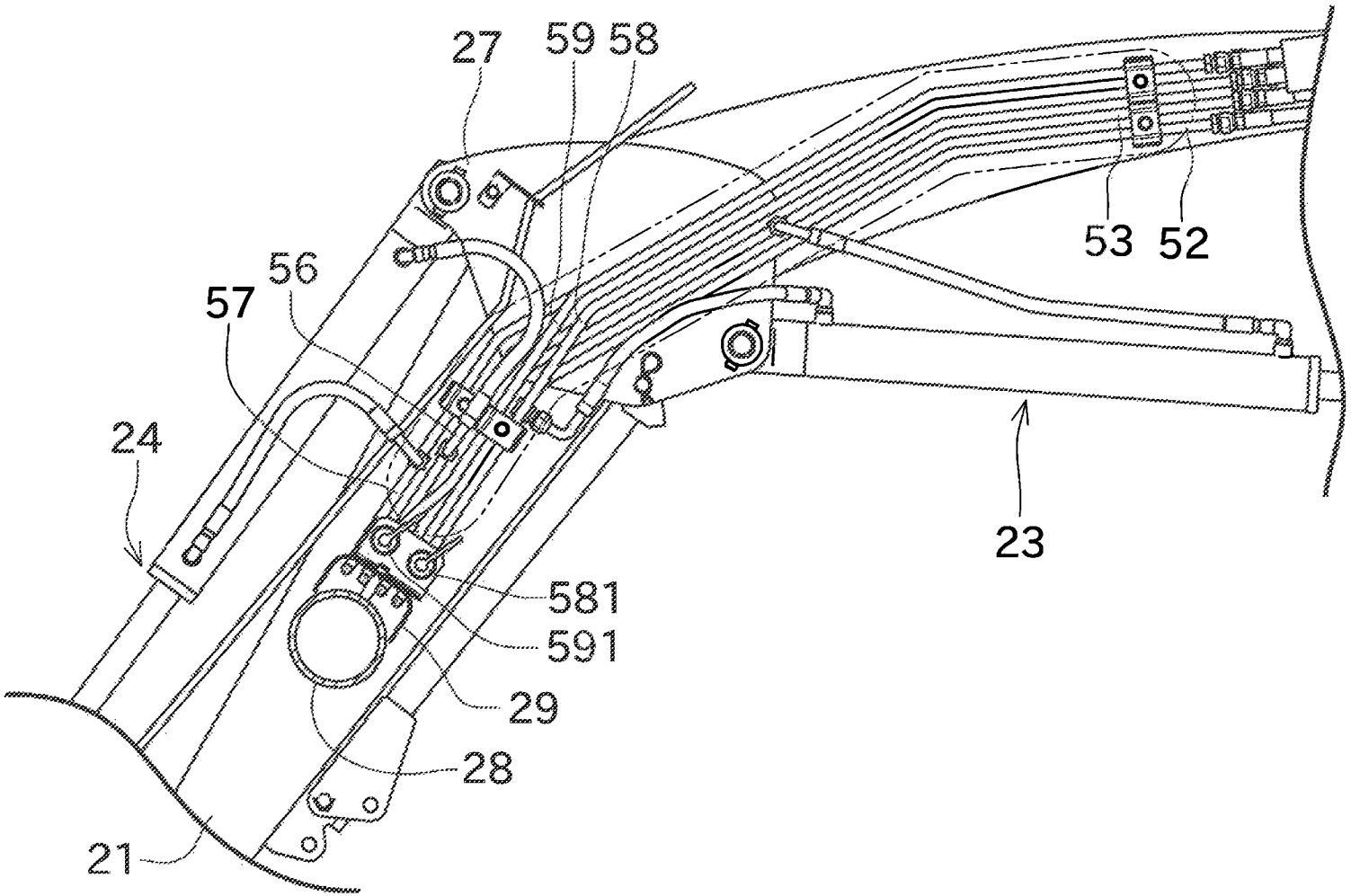
FIG. 4 is a side view of a right boom as seen from the vehicle body side.

Hereinafter, a preferred embodiment of the present invention will be described with reference to the accompanying drawings FIG. 2 is a perspective view showing an entire structure of a tractor 10 according to an embodiment of the present invention. FIG. 3 is a perspective view showing structure around a loader control lever 19, a multiple valve 42, and a magnetic valve 44, FIG. 4 is a side view showing a right boom 21 as seen from the vehicle body side. In the present specification, by the simple expression of "left side" and "right side", for example, the left side and the right side with respect to a direction of forward movement of the tractor are meant, respectively.

The tractor (work vehicle) 10 shown in FIG. 2 includes, as main components, a vehicle body 11, a frame 12, front wheels 14, rear wheels 15, a front loader (loader) 16, and a driver's seat 17.

A hood is provided in a front portion of the vehicle body 11. An oil supply tank, an engine, and the like, are arranged inside the hood. The frame 12 is provided in a lower portion of the tractor 10, and supports the engine. Power outputted by the engine is transmitted to the front wheels 14 and the rear wheels 15 via a transmission mechanism (not shown). The front wheels 14 and the rear wheels 15 are rotated by the power of the engine being transmitted thereto, and thus move the tractor 10.

The driver's seat 17 is provided in a rear portion of the vehicle body 11. An operator sits on the driver's seat 17 and performs various operations. The operator operates a steering wheel 18, the loader control lever (operating part) 19, a pedal, and the like, which are installed near the driver's seat 17, and thereby can change a traveling direction of the tractor 10 and move the front loader 16.

The vehicle body 11 of the tractor 10 has loader mounting plates 31, a support shaft 32, and boom supporters 33, as a structure allowing the front loader 16 to be mounted to a front portion of the vehicle body 11. The loader mounting plate 31 is in the shape of a flat plate, and attached to each of the left and right side surfaces of the frame 12. The support shaft 32 is fixed to the loader mounting plates 31 so as to protrude toward the outside of the vehicle body.

The boom supporter 33 is fixed so as to extend upward from a distal end of the support shaft 32. A coupling member 20 provided in the front loader 16 is removably attached to the boom supporter 33.

As shown FIG. 2, the front loader 16 has a pair of coupling members 20, a pair of booms 21, a pair of lift cylinders (first drive part) 23, and a pair of dump cylinders (second drive part) 24. A boom coupling member 28 shown in FIG. 4 is arranged horizontally between the left and right booms 21, to couple the left and right booms 21 to each other.

The boom 21 is rotatably supported on an upper end portion of the coupling member 20. The boom 21 is formed so as to extend to the front of the tractor 10 while being curved in an arc shape. A proximal end (an end at the vehicle rear side) of the boom 21 is rotatably coupled to an upper portion of the coupling member 20, and a distal end (an end at the vehicle front side) thereof is rotatably coupled to a hitch (attaching part) 25. An implement such as a bucket 26 and a roll grab 70 which will be described later can be removably attached to the hitch 25.

The front loader 16 has first links 61, second links 62, and link coupling parts 63. One end of the first link 61 is coupled to the second link 62, and the other end thereof is coupled to a portion of the boom 21 near the distal end thereof. One end of the second link 62 is coupled to the first link 61, and the other end thereof is coupled to the hitch 25. The link coupling part 63 includes a coupling shaft and the like, and arranged at a position where the first link 61 and the second link 62 are coupled to each other.

A cylinder bearing plate 27 is arranged substantially at the center of the boom 21 with respect to the longitudinal direction thereof. One end of the lift cylinder 23 is connected to the cylinder bearing plate 27, and the other end thereof is connected to the coupling member 20. One end of the dump cylinder 24 is connected to the cylinder bearing plate 27, and the other end thereof is connected to the link coupling part 63. The lift cylinders 23 and the dump cylinders 24 are configured as double-acting cylinders, and each of them is connected to a valve which will be described later via two hydraulic pipes. These cylinders are controlled by an operation performed on the loader control lever 19.

In this structure, extension of the lift cylinders 23 rotates the booms 21 upward, and retraction of the lift cylinders 23 rotates the booms 21 downward. Retraction of the dump cylinders 24 rotates the bucket 26 upward (scooping action), and extension of the dump cylinders 24 rotates the bucket 26 downward (dumping action). By changing the flow rate of an operating oil by a speed-up circuit 43 which will be described later, the dump cylinders 24 can perform the dumping action at a high speed.

Figure 5:
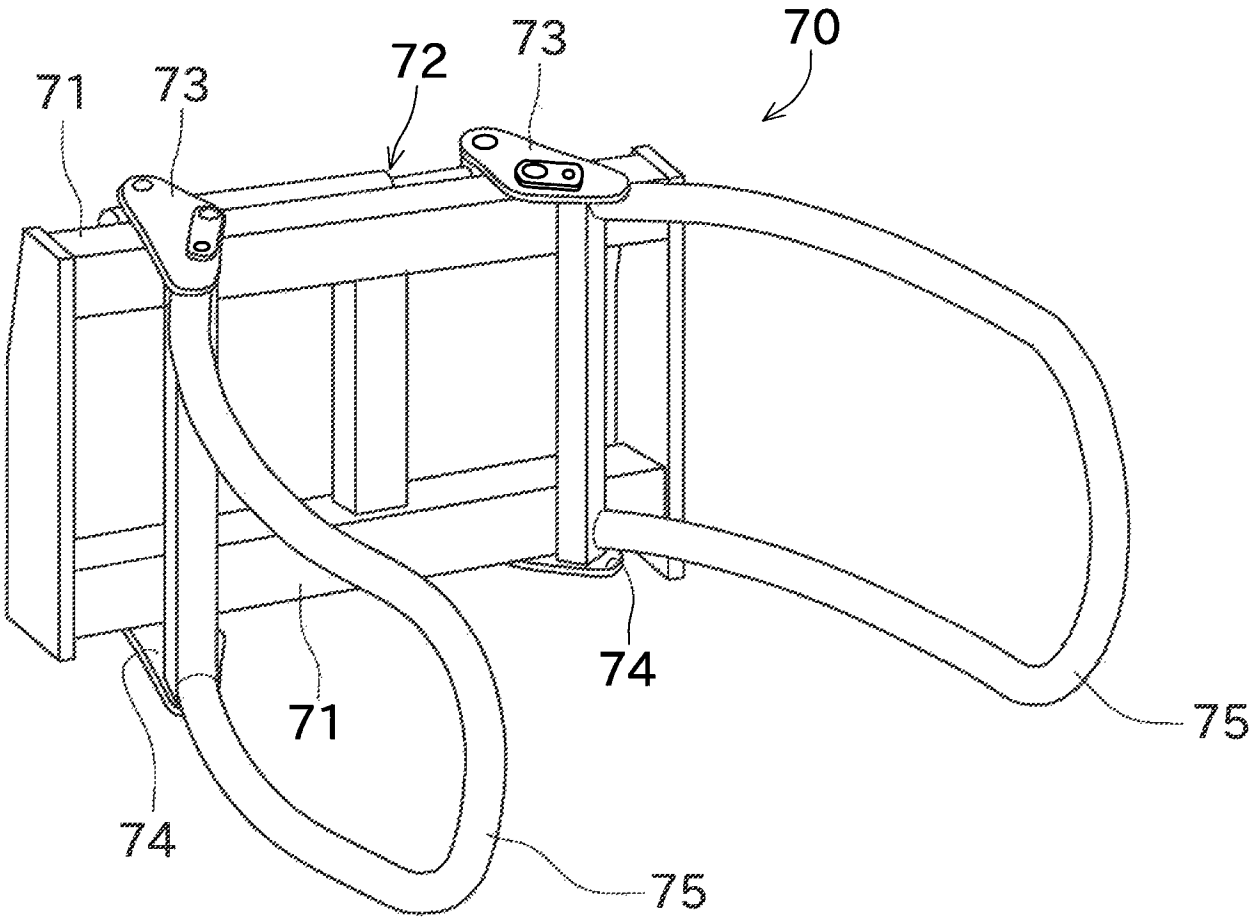
FIG. 5 is a perspective view showing a structure of a roll grab.

Instead of the bucket 26, the roll grab 70 can be attached to the hitch 25. Hereinafter, a structure of the roll grab 70 will be described with reference to FIG. 5. FIG. 5 is a perspective view showing a structure of the roll grab 70. In a description of the roll grab 70, a "left-and-right direction" and a "front-and-rear direction" indicate the left-and-right direction and the front-and-rear direction with respect to the tractor 10 having the roll grab 70 attached to the hitch 25, respectively.

The roll grab 70 is an implement for transporting, for example, a roll bale formed by shaping compressed hay into a column. As shown in FIG. 5, the roll grab 70 has grab frames 71, a grab cylinder (third drive part) 72, a pair of swing plates 73, a pair of swing plates 74, and a pair of gripping arms 75.

The grab frame 71 is a member having a rectangular parallelepiped shape and extending in the left-and-right direction. Two of the upper and lower grab frames 71 are arranged side by side. The grab cylinder 72 is arranged at the rear side of the upper grab frame 71. The grab cylinder 72 is configured as a double-acting cylinder, and driven to extend and retract in the left-and-right direction by the operating oil being supplied from an operating-oil tank of the tractor 10.

The pair of swing plates 73 are for supporting the gripping arms 75 and for transmitting the extension and retraction of the grab cylinder 72 to the gripping arms 75. The pair of swing plates 73 are rotatably attached to an upper surface of the grab frame 71. One of the pair of swing plates 73 is rotatably attached to a portion of the grab cylinder 72 at one side thereof, and the other of the pair of swing plates 73 is rotatably attached to a portion of the grab cylinder 72 at the other side thereof.

The pair of swing plates 74 are for supporting the gripping arms 75, and rotatably attached to a lower surface of the grab frame 71.

The pair of gripping arms 75 are for gripping and holding the roll bale or the like. Each of the gripping arms 75 is formed by a column-shaped member being bent in an appropriate manner. An upper end of each gripping arm 75 is fixed to the swing plate 73, and a lower end thereof is fixed to the swing plate 74.

In this structure, extension of the grab cylinder 72 rotates the swing plates 73 and the plates 74, to bring the pair of gripping arms 75 close to each other (gripping action). Retraction of the grab cylinder 72 rotates the swing plates 73 and the swing plates 74 is the reverse direction, to separate the pair of gripping arms 75 away from each other (releasing action).

Figure 6:
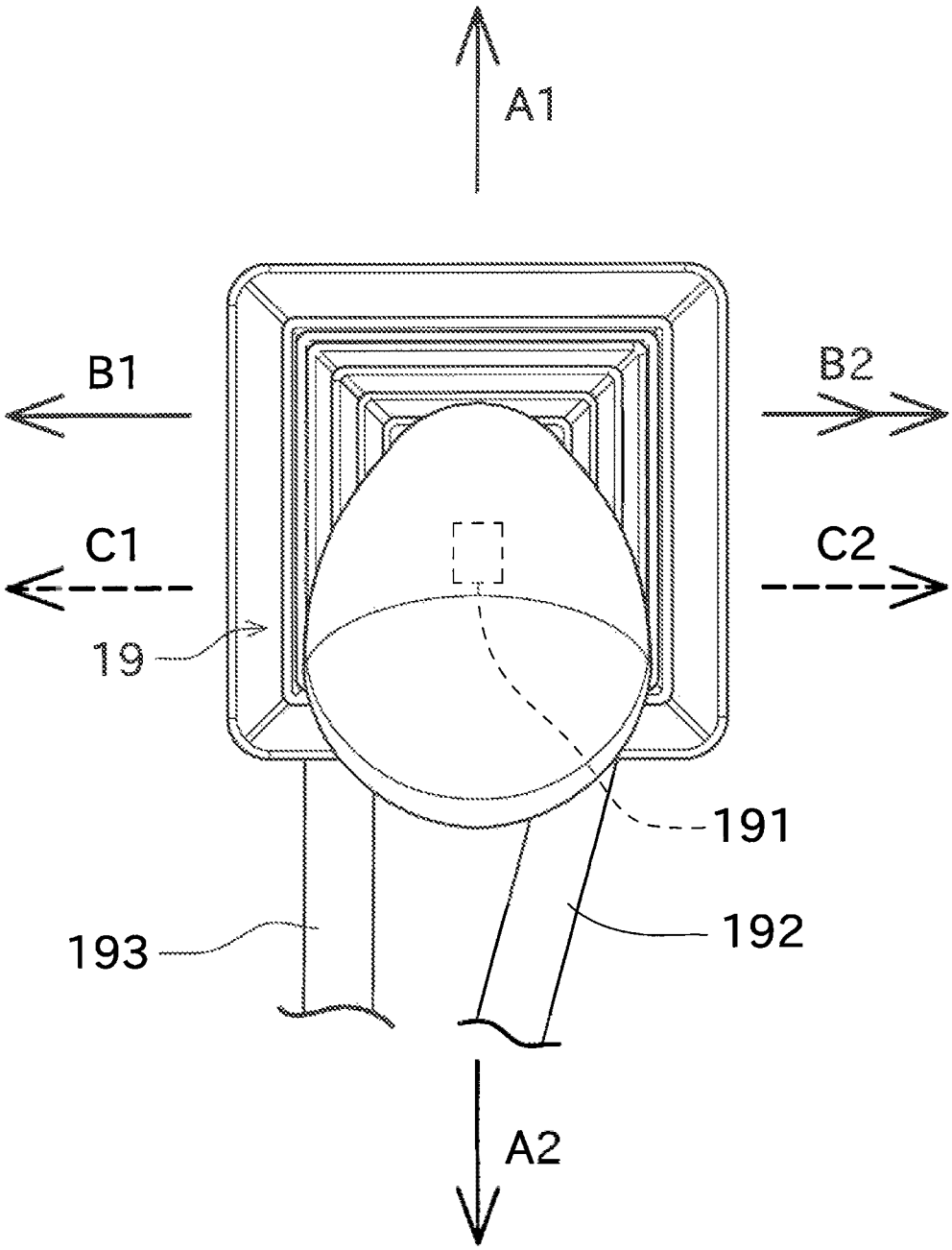
FIG. 6 is a diagram showing a method for operating the loader control lever.

Next, a method for operating the front loader 16 by using the loader control lever 19 will be described with reference to FIG. 6. FIG. 6 is a diagram showing a method for operating the loader control lever 19.

As shown in FIGS. 2 and 6, the loader control lever 19 has a lever switch 191. The loader control lever 19 is movable in the front-and-rear direction (indicated by the arrows A1 and A2 in FIG. 6) and the left-and-right direction (indicated by the arrows B1 and B2 in FIG. 6).

An operation in the front-and-rear direction is for controlling a supply of the operating oil to the lift cylinders 23. More specifically, when the loader control lever 19 is moved rearward (as indicated by the arrow A2), the lift cylinders 23 extend to raise the booms 21. When the loader control lever 19 is moved frontward (as indicated by the arrow A1), the lift cylinders 23 retract to lower the booms 21

An operation in the left-and-right direction is for controlling a supply of the operating oil to the dump cylinders 24 or controlling a supply of the operating oil to the grab cylinder 72. Which of the cylinders is subjected to the control of the supply of the operating oil can be switched by operating the lever switch 191.

To be specific, when the loader control lever 19 is moved leftward (as indicated by the arrow B1) without pressing the lever switch 191, the dump cylinders 24 retract to rotate the bucket 26 or the like upward. When the loader control lever 19 is moved rightward (as indicated by the arrow 32) without pressing the lever switch 191, the dump cylinders 24 extend to rotate the bucket 25 or the like downward. When the loader control lever 19 is moved rightward (as indicated by the arrow B2) beyond a predetermined stroke, the flow rate of the supplied operating oil is increased so that the bucket 26 or the like can be quickly moved downward.

When the loader control lever 19 is moved leftward (as indicated by the arrow C1) with pressing the lever switch 191, the grab cylinders 72 retract to separate the pair of gripping arms 75 away from each other. When the loader control lever 19 is moved rightward (as indicated by the arrow C2) with pressing the lever switch 191, the grab cylinder 72 extend to bring the pair of gripping arms 75 close to each other. In this embodiment, a speed-up restricting arm 46 which will be described later prevents an increase of the flow rate of the operating oil supplied to the grab cylinder 72.

Figure 1:
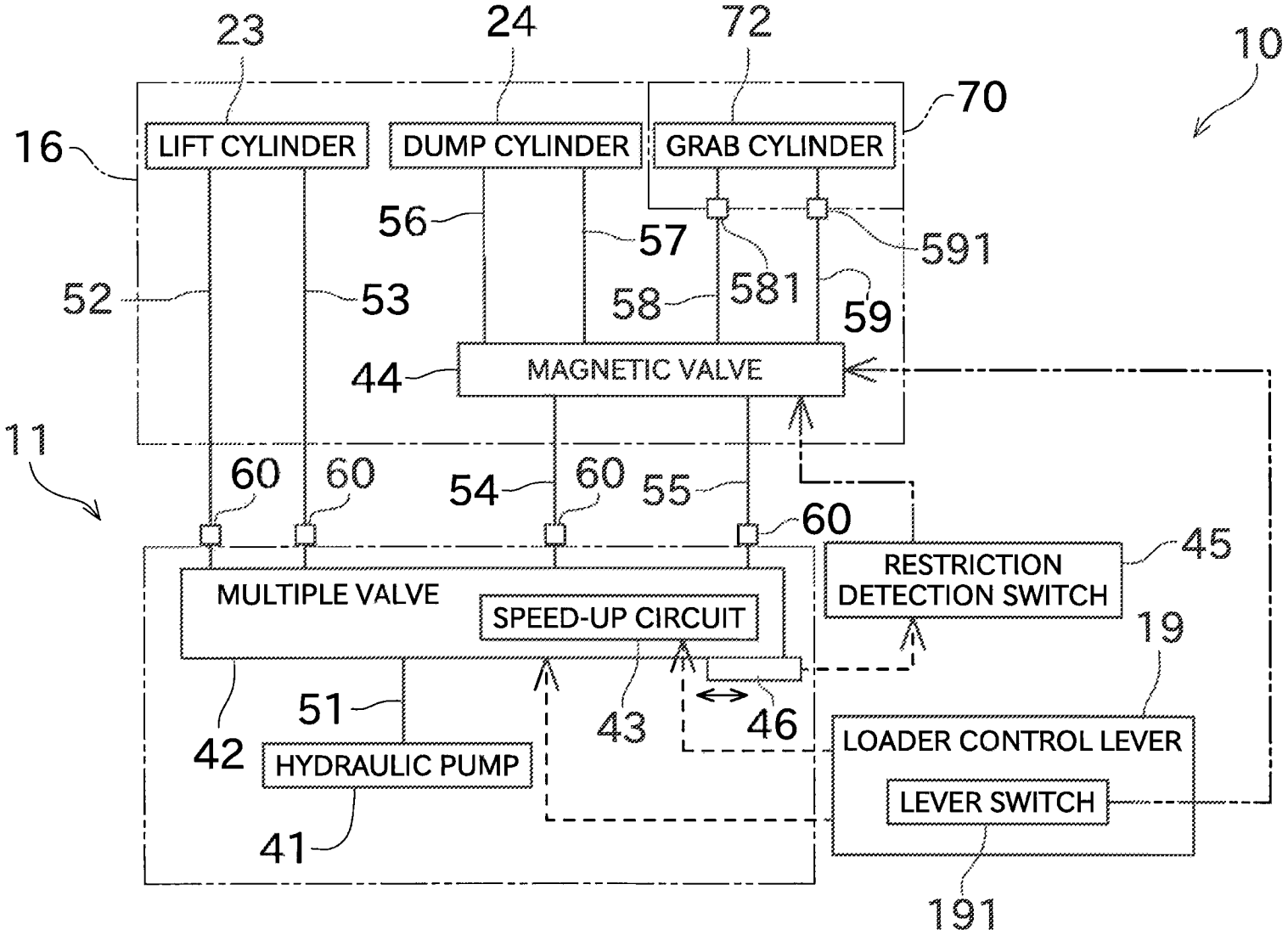
FIG. 1 is a diagram showing a layout of hydraulic equipments and hydraulic pipes.
Figure 7:
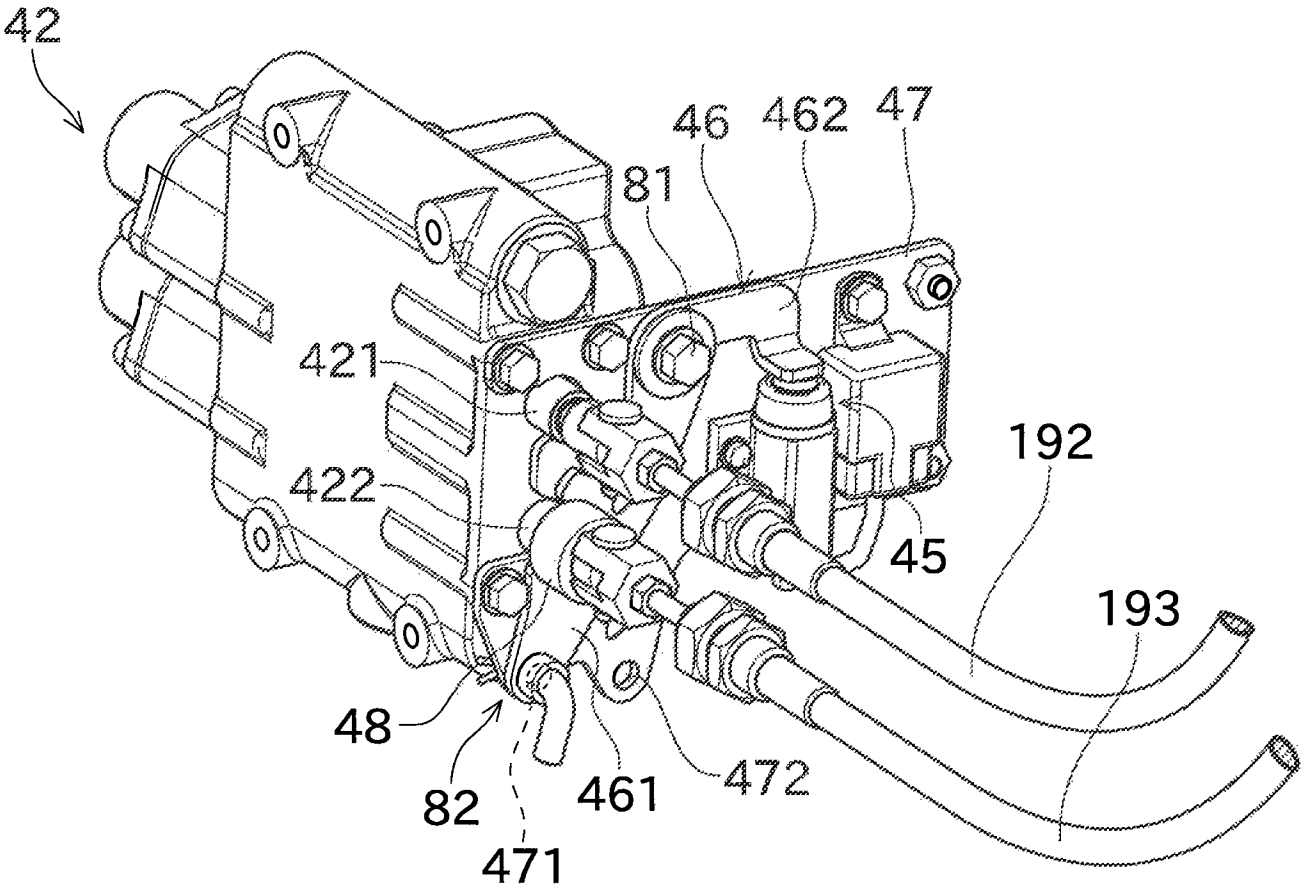
FIG. 7 is a perspective view showing a structure near the multiple valve.
Figure 8:
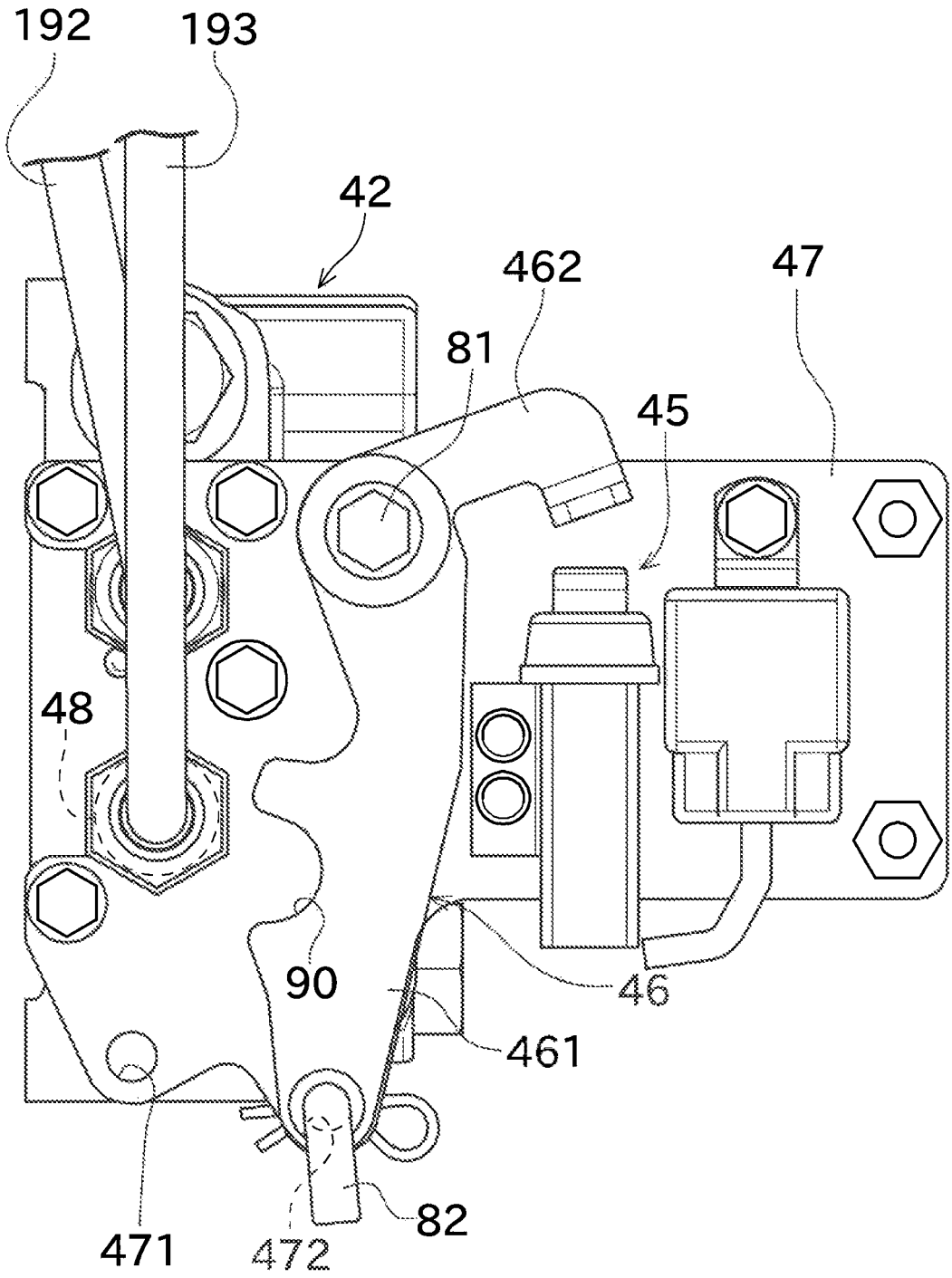
FIG. 8 is a rear view showing a position of a speed-up restricting arm in a case of using a bucket.
Figure 9:
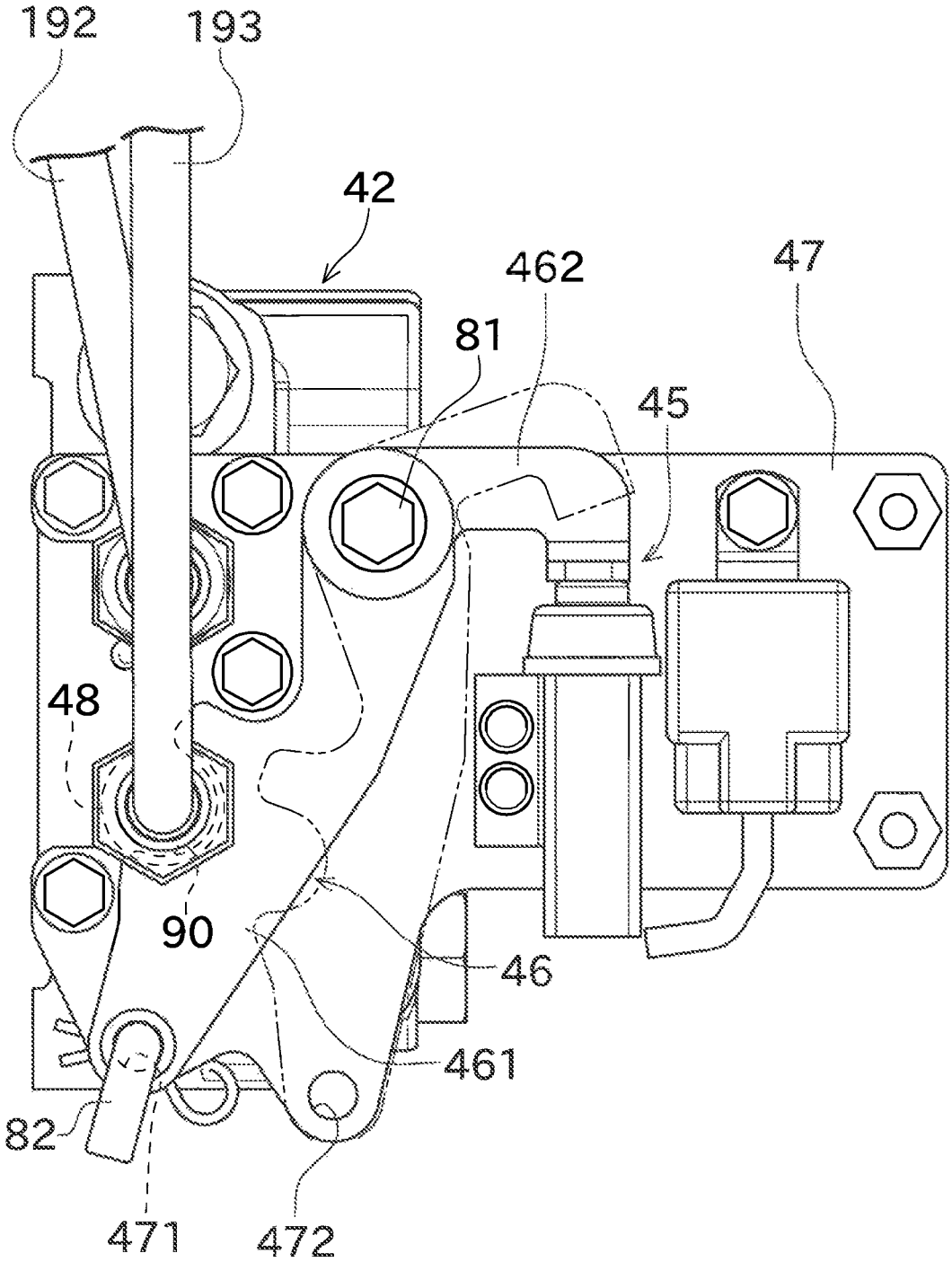
FIG. 9 is a rear view showing a position of the speed-up restricting arm in a case of using the roll grab.

Next, hydraulic equipments of the tractor 10, and a flow of supply of the operating oil to the hydraulic equipments will be described with reference to FIG. 1, and FIGS. 7 to 9. FIG. 1 is a diagram showing a layout of hydraulic equipments and hydraulic pipes. FIG. 7 is a perspective view showing a structure near the multiple valve 42. FIG. 8 is a rear view showing a position of the speed-up restricting arm 46 in a case of using the bucket 26. FIG. 9 is a rear view showing a position of the speed-up restricting arm 46 in a case of using the roll grab 70. In FIG. 7 and the like, for a clearer illustration of the structure, a coupler 60, hydraulic pipes, and the like, are removed from the multiple valve 42.

As shown in FIG. 1, the tractor 10 has a hydraulic pump 41 and the multiple valve 42, which are the hydraulic equipments provided in the vehicle body 11. The tractor 10 has the magnetic valve (switching valve) 44 in addition to the lift cylinders the dump cylinders 24, and the grab cylinder 72 described above, which are the hydraulic equipments provided in the front loader 16.

The hydraulic pump 41 functions as a hydraulic source of a hydraulic circuit that operates the front loader 16. The hydraulic pump 41 sucks the operating oil from an oil tank (not shown) provided in the tractor 10, and sends out the sucked operating oil to the multiple valve 42 through a hydraulic pipe 51.

The multiple valve 42 is connected to the hydraulic pump 41. The multiple valve 42 is also connected to the lift cylinder 23 via hydraulic pipes 52 and 53, and connected to the magnetic valve 44 via hydraulic pipes 54 and 55. A coupler 60 is interposed between the multiple valve 42 and each of the hydraulic pipes 52, 53, 54, and 55. Accordingly, to remove the front loader 16 from the vehicle body 11, the hydraulic pipes 52, 53, 54, and 55 can be separated from the multiple valve 42 at the couplers 60.

As shown in FIG. 7, the multiple valve 42 includes slidable input members 421 and 422. Within the multiple valve 42, the input members 421 and 422 are coupled to a spool (not shown) that switches a path of the operating oil.

The input members 421 and 422 are mechanically connected to the loader control lever 19 via lever cables 192 and 193 (more specifically, wires arranged in the cables) shown in FIGS. 2, 7, and the like. An operating force applied to the loader control lever 19 is transmitted to the input members 421 and 422 via the wires of the lever cables 192 and 193, respectively, to thereby change the position of the spool within the multi valve 42, so that a destination of the operating oil and a direction of driving the destination cylinder can be changed.

To be specific, when the loader control lever 19 is operated in the front-and-rear direction, a wire portion of the lever cable 192 pushes and pulls the input member 421. Thereby, the operating oil is supplied to the lift cylinder 23 through one of the hydraulic pipe 52 and the hydraulic pipe 53, and discharged through the other of the hydraulic pipe 52 and the hydraulic pipe 53. This consequently causes the lift cylinder 23 to extend and retract.

When the loader control lever 19 is operated in the left-and-right direction, a wire portion of the lever cable 193 pushes and pulls the input member 422. Thereby, the operating oil is supplied to the magnetic valve 44 through one of the hydraulic pipe 54 and the hydraulic pipe 55, and discharged through the other of the hydraulic pipe 54 and the hydraulic pipe 55. The operating oil supplied to the magnetic valve 44 is supplied to the dump cylinders 24 or the grab cylinder 72.

The magnetic valve 44 is connected to the dump cylinder 24 via hydraulic pipes 56 and 57, and connected to the grab cylinder 72 via hydraulic pipes 58 and 59. The magnetic valve 44 is electrically connected to the lever switch 191. When the lever switch 191 is not pressed, the magnetic valve 44 supplies the operating oil to the dump cylinder 24 through the hydraulic pipe 56 or the hydraulic pipe 57. When the lever switch 191 is pressed, the magnetic valve 44 supplies the operating oil to the grab cylinder 72 through the hydraulic pipe 58 or the hydraulic pipe 59.

This structure causes the dump cylinders 24 and the grab cylinder 72 to extend and retract in accordance with the operation of the loader control lever 19 and the lever switch 191.

As shown in FIG. 4, the hydraulic pipes 52, 53, and 56 to 59 are attached to an inner surface (surface facing the vehicle body side) of the boom 21. Therefore, in a region enclosed by a dot-dash-line in FIG. 4, the hydraulic pipes 52, 53, and 56 to 59 extend near the inner surface of the boom 21 while substantially following the boom 21 in the longitudinal direction thereof. In a side view, the hydraulic pipes 58 and 59 partially overlap the hydraulic pipes 56, 57 and the hydraulic pipes 52, 53, within the region enclosed by the dot-dash-line. This allows a compact arrangement of a plurality of hydraulic pipes.

A covering member 29 for covering the hydraulic pipes is attached to the boom coupling member 28 that couples the pair of booms 21 to each other. The covering member 29 has a substantially U-shaped cross-section. The hydraulic pipes 52, 53, 56, and 57 pass through an internal space of the covering member 29 (a space between the boom coupling member 28 and the covering member 29). These hydraulic pipes pass through the covering member 29, and then are connected to the lift cylinder 23 and the dump cylinder 24 arranged at the left side.

The hydraulic pipes 58 and 59 are fixed to an outer surface of the covering member 29 via an appropriate fixing member. Hydraulic-pressure extraction ports 581 and 591 are formed at distal end portions of the hydraulic pipes 58 and 59, respectively. The hydraulic-pressure extraction ports 581 and 591 are connectable to the grab cylinder 72 via a coupler (not shown) and a hydraulic pipe (not shown).

A portion of the front loader 16 around the boom coupling member 28 is relatively likely to be covered with soil or the like having dropped out of the bucket 26 provided frontward, during the operation using the bucket 26. In this respect, since the hydraulic-pressure extraction ports 581 and 591 are arranged such that they are directed to the left side, foreign materials such as soil cannot easily enter the hydraulic circuit, as compared with a case where the hydraulic-pressure extraction ports 581 and 591 are arranged such that they are directed to the front side. Instead of the structure of this embodiment, the hydraulic-pressure extraction ports 581 and 591 may be arranged such that they are directed to the right side.

Next, an arrangement of the magnetic valve 44 forming the above-described hydraulic circuit will be described. In, this embodiment, the magnetic valve 44 that switches the supply of the operating oil between the dump cylinder 24 and the grab cylinder 72 is provided in the front loader 16. In other words, in a state where the front loader 16 is removed from the vehicle body 11 of the tractor, the magnetic valve 44 is separated from the vehicle body 11 and located in the front loader 16

Here, assuming that the magnetic valve 44 is arranged in the vehicle body 11 of the tractor 10, in order to mount the front loader 16 to the vehicle body 11, it is necessary not only to connect the multiple valve 42 to the lift cylinder 23, but also to connect the magnetic valve 44 to the dump cylinder 24 and to connect the magnetic valve 44 to the grab cylinder 72. Thus, a connecting operation has to be performed with respect to six hydraulic pipes.

In this embodiment, on the other hand, as shown in FIG. 1, the hydraulic circuit for operating the front loader 16 can be established merely by connecting the multiple valve 42 to the lift cylinder 23 with the coupler 60 and connecting the multiple valve 42 to the magnetic valve 44 with the coupler 60. Therefore, a connecting operation with respect to four hydraulic pipes 52, 53, 54, and 55 suffices. Thus, in this embodiment, the connection between the hydraulic equipments can be simplified, and the number of couplers 60 can be reduced.

It may be acceptable that, in a case where the fact that an operation using the grab cylinder 72 is not performed is known, the multiple valve 42 and the magnetic valve 44 are not connected to each other and instead the multiple valve 42 and the dump cylinder 24 are directly connected to each other.

Next, a structure for increasing the speed of the dumping action of the bucket 26 will be described. As shown in FIG. 1, a speed-up circuit (speed-up part) 43 is provided within the multiple valve 42. The speed-up circuit 43 can perform a speed-up operation for increasing the flow rate (per unit time) of the operating oil supplied to the magnetic valve 44.

In this embodiment, when the loader control lever 19 is moved rightward (as indicated by the arrow B2), the wire portion of the lever cable 193 pushes the input member 422. If the spool, which is pushed together with the input member 422, is moved by a predetermined distance or more in the multiple valve 42, the speed-up circuit 43 is switched to a speed-up side, to increase the flow rate of the operating oil supplied to the magnetic valve 44 as compared with a normal mode. In this structure, when the loader control lever 19 is tilted in the direction indicated by the arrow B2 to a large extent, the dumping action of the bucket 26 can be performed at a higher speed than the scooping action.

If the speed-up operation of the speed-up circuit 43 is effective in a case of performing an operation using the roll grab 70, only one of the closing operation and the opening operation of the gripping arm 75 can be quickly performed, which may confuse the operator. In this respect, in the tractor 10 of this embodiment, the speed-up operation of the speed-up circuit 43 is inhibited during the operation using the roll grab 70.

A detailed description will be given below. As shown in FIG. 7, an attaching plate 47 is fixed to a rear surface of the multiple valve 42. A restriction detection switch (detecting part) 45 and the speed-up restricting arm (restricting part) 46 are attached to the attaching plate 47.

The speed-up restricting arm 46 is rotatably attached to the attaching plate 47 via a shaft member 81. The speed-up restricting arm 46 is attached near the multiple valve 42. That is, the position where the speed-up restricting arm 46 is placed is near the speed-up circuit 43 provided within the multi valve 42. The speed-up restricting arm 46 has a first arm 461 and a second arm 462.

The first arm 461 is configured to function as a stopper for preventing displacement of the input member 422. A recess 90 is formed in the middle of the first arm 461 with respect to a longitudinal direction thereof. A peripheral edge of the recess 90 can be brought into contact with a contact member 48 fixed to the input member 422.

The second arm 462 is shorter than the first arm 461. A pressing part is formed at a distal end, of the second arm 462, and the pressing part can press the restriction detection switch 45.

The speed-up restricting arm 46 is rotated around the shaft member 81, and thereby switched between a retracted position shown in FIG. 8 and a restricting position illustrated with the solid line in FIG. 9. An attaching hole is formed at a distal end of the first arm 461. Accordingly, in a portion of the attaching plate 47 near one end (lower end) thereof, two holes 471 and 472 are formed so as to correspond to the attaching hole, as shown in FIG. 8 and the like.

In the tractor 10 structured as described above, in a case of performing the operation using the bucket 26, the operator moves the speed-up restricting arm 46 to the retracted position and, as shown in FIG. 8, fixes the speed-up restricting arm. 46 by inserting a fixture 82 into the attaching hole and the hole 472. In a case of performing the operation using the roll grab 70, the operator moves the speed-up restricting arm 46 to the restricting position and, as shown in FIG. 9, fixes the speed-up restricting arm 46 by inserting the fixture 82 into the attaching hole and the hole 471.

When the speed-up restricting arm 46 is switched to the restricting position, the input member 422 of the multiple valve 42 enter the recess 90 formed in the first arm 461, as shown in FIG. 9. An edge portion of the recess 90 of the first arm 461 is inserted between the attaching plate 47 and the contact member 48 fixed to the input member 422. In this state, even if the loader control lever 19 is operated in the direction indicated by the arrow B2 of FIG. 6, the contact member 48 and the speed-up restricting arm 46 are brought into contact at a time point when the displacement of the input member 422 (spool) reaches a predetermined amount, thus inhibiting any more displacement. Thereby, the speed-up operation of the speed-up circuit 43 can be prevented.

In a case where the speed-up restricting arm 46 is in the restricting position, the restriction detection switch 45 is pushed by the second arm 462, as shown in FIG. 9. As shown in FIG. 1, the restriction detection switch 45 is electrically connected to the magnetic valve 44. The magnetic valve 44 is configured to supply the operating oil to the grab cylinder 72 only when both of the restriction detection switch 45 and the lever switch 191 are pressed.

Therefore, if the speed-up restricting arm 46 is not in an appropriate position, the operation of the roll, grab 70 cannot be performed. This can furthermore ensure the prevention of the speed-up operation of the roll grab 70.

As described above, the tractor 10 of this embodiment includes the vehicle body 11, the booms 21, the lift cylinders 23, the hitch 25, the dump cylinders 24, the magnetic valve 44, the speed-up circuit 43, and the speed-up restricting arm 46. The booms 21 are configured to extend to the front of the vehicle body 11. The lift cylinders 23 swing the booms 21 upward and downward by the operating oil being supplied thereto. The hitch 25 is provided to the booms 21 such that an implement can be attached thereto. The dump cylinders 24 swing the implement upward and downward by the operating oil being supplied thereto. The magnetic valve 44 switches the supply of the operating oil between a supply to the dump cylinders 24 and a supply to the grab cylinder 72 provided in the implement. The speed-up circuit 43 can perform the speed-up operation for increasing the flow rate of the operating oil supplied to the magnetic valve 44. The speed-up restricting arm 46 is arranged near the speed-up circuit 43. The speed-up restricting arm 46 is brought into contact with the contact member 48 fixed to the input member 422 for switching the operation of the speed-up circuit 43, and thereby restricts the speed-up operation, to prevent a speed-up of the grab cylinder 72.

This enables a speed-up of the dumping action of the bucket 26, and the like, by increasing the flow rate of the operating oil supplied to the dump cylinder 24 while, in a case of performing an operation with attaching an implement (such as the roll grab 70) having the grab cylinder 72, preventing a speed-up of an action of the implement (such as the gripping action of the roll grab 70). Therefore, an operation can be appropriately performed using the implement having the grab cylinder 72. Additionally, since the speed-up restricting arm 46 is arranged near the speed-up circuit 43, the speed-up operation can be restricted by means of a simple and compact mechanism.

The tractor 10 of this embodiment includes the loader control lever 19 and the restriction detection switch 45. The loader control lever 19 can perform the operation for driving the grab cylinder 72. The restriction detection switch 45 detects that the speed-up operation is restricted (that the speed-up restricting arm 46 is in the restricting position). When the operation for driving the grab cylinder 72 is performed by using the loader control lever 19 and additionally the restriction detection switch 45 detects that the speed-up operation is being restricted, the magnetic valve 44 supplies the operating oil to the grab cylinder 72.

As a result, in a state where the speed-up operation is not restricted, the operation using the grab cylinder 72 is inhibited. Therefore, a speed-up of an action of the roll grab 70 can be prevented in a case where, for example, the operator has replaced the bucket 26 with the roll grab 70 but nevertheless failed to switch the speed-up restricting arm 46.

The tractor 10 of this embodiment has the front loader 16 that is attachable to and removable from the vehicle body 11. The front loader 16 includes at least the booms 21, the hitch 25, the lift cylinders 23, and the dump cylinders 24. In a state where the front loader 16 is removed from the vehicle body 11, the magnetic valve 44 is located in the front loader 16.

Thus, to mount the front loader 16 to the vehicle body 11, a necessary operation of connecting hydraulic pipes is merely connecting the hydraulic pipes extending from the operating-oil tank of the vehicle body 11 to the lift cylinders 23 and to the magnetic valve 44 of the front loader 16. That is, it is not necessary to individually connect and disconnect the hydraulic pipes to and from the dump cylinders 24 and the grab cylinder 72. This enables the front loader 16 to be easily mounted and removed.

The tractor 10 of this embodiment includes the hydraulic pipes 52, 53, and 56 to 59 for supplying the operating oil to the lift cylinders 23, the dump cylinders 24, and the grab cylinder 72. The hydraulic pipes 52, 53, and 56 to 59 are arranged so as to define a passing region (the region indicated by the dot-dash-line of FIG. 4) where the hydraulic pipes 52, 53, and 56 to 59 pass near the surface of the boom 21 facing the vehicle body 11 side. In the passing region, at least one hydraulic pipe overlaps at least a part of the other hydraulic pipes (more specifically, the hydraulic pipe 58 partially overlaps the hydraulic pipe 56, for example) in a side view.

Thus, the hydraulic pipes are attached so as to pass inside the boom 21. This can prevent the hydraulic pipes from being damaged due to a contact with an obstacle existing outside. Moreover, such a layout in which the hydraulic pipes overlap each other can prevent the hydraulic pipes from sticking out of the booms 21 even if the boom 21 is thin (or the hydraulic pipe is thick).

Although a preferred embodiment of the present invention has been described above, the above-described structure may be modified as follows.

Although in the above-described embodiment, the tractor 10 is adopted as a work vehicle, the above-described structure is applicable to another vehicle as long as the vehicle is a work vehicle to and from which a loader such as the front loader 16 can be attached and removed.

The speed-up restricting arm 46 described above is illustrative, and a member having any shape is adoptable as the restricting part as long as the member is configured to be brought into contact with the speed-up part or with a member attached to the speed-up part to thereby restrict the speed-up operation.

Although in the above-described embodiment, the roll grab 70 is taken as an example of the implement having the third drive part (grab cylinder 72), any appropriate implement may be used as long as the implement has the third drive part. The effects of the present invention can be exerted even in a case where a grapple, a bucket having an openable bottom, or the like, is attached instead of the roll grab 70, for example.

Instead of the cylinders, other hydraulic actuators may be used as the drive parts for driving the boom 21, the bucket 26, and the roll grab 70.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A work vehicle comprising:

a vehicle body;

a boom extending to the front or to the rear of the vehicle body;

a first drive part configured to swing the boom upward and downward by an operating oil being supplied thereto;

an attaching part provided to the boom to allow an implement to be attached thereto;

a second drive part configured to swing the implement upward and downward by the operating oil being supplied thereto;

a switching valve configured to switch between supplying the operating oil to the second drive part and supplying the operating oil to a third drive part provided in the implement;

a speed-up part able to perform a speed-up operation for increasing the flow rate of the operating oil supplied to the switching valve; and a restricting part arranged near the speed-up part and configured to be brought into contact with a switching member for switching an operation of the speed-up part or with a member attached to the switching member, to thereby restrict the speed-up operation so that a speed-up of the third drive part prevented.

2. A work vehicle according to claim 1, comprising:

an operating part able to perform an operation for driving the third drive part; and a detecting part configured to detect that the speed-up operation is restricted, wherein when the operation for driving the third drive part is performed by using the operating part and the detecting part detects that the speed-up operation is restricted, the switching valve supplies the operating oil to the third drive part.

3. The work vehicle according to claim 1, comprising a loader attachable to and removable from the vehicle body, wherein the loader includes at least the boom, the attaching part, the first drive part, and the second drive part, in a state where the loader is removed from the vehicle body, the switching valve is located in the loader.

4. The work vehicle according to claim 1, comprising hydraulic pipes for supplying the operating oil to the first drive part, the second drive part, and the third drive part, wherein the hydraulic pipes are arranged so as to define a passing region where the hydraulic pipes pass near a surface of the boom facing the vehicle body side, and in the passing region, at least one of the hydraulic pipes overlaps at least a part of the other hydraulic pipes in a side view.

* * * * *